US009581921B2

(12) United States Patent
Okada et al.

(10) Patent No.: US 9,581,921 B2
(45) Date of Patent: Feb. 28, 2017

(54) ELECTROPHOTOGRAPHIC PHOTOSENSITIVE MEMBER

(71) Applicant: KYOCERA Document Solutions Inc., Osaka-shi (JP)

(72) Inventors: Hideki Okada, Osaka (JP); Fumio Sugai, Osaka (JP); Kensuke Kojima, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/808,114

(22) Filed: Jul. 24, 2015

(65) Prior Publication Data

US 2016/0033885 A1 Feb. 4, 2016

(30) Foreign Application Priority Data

Jul. 29, 2014 (JP) ..... 2014-154163

(51) Int. Cl.

| | |
|---|---|
| ***G03G 5/00*** | (2006.01) |
| ***G03G 5/06*** | (2006.01) |
| ***G03G 5/047*** | (2006.01) |

(52) U.S. Cl.

CPC ..... *G03G 5/0618* (2013.01); *G03G 5/047* (2013.01); *G03G 5/0614* (2013.01); *G03G 5/0672* (2013.01); *G03G 5/0696* (2013.01)

(58) Field of Classification Search

CPC .. G03G 5/0618; G03G 5/0672; G03G 5/0614; G03G 5/047; G03G 5/0696

(Continued)

(56) References Cited

U.S. PATENT DOCUMENTS

2006/0204871 A1* 9/2006 Kondoh ..... C07C 211/58
430/58.85
2012/0156599 A1 6/2012 Obata et al.

FOREIGN PATENT DOCUMENTS

JP H10-239875 A 9/1998
JP 2000-112157 A 4/2000

(Continued)

*Primary Examiner* — Thorl Chea
(74) *Attorney, Agent, or Firm* — Studebaker & Brackett PC

(57) ABSTRACT

An electrophotographic photosensitive member includes a photosensitive layer containing a charge generating material, a charge transport material, and a binder resin. The photosensitive layer is a multi-layer type photosensitive layer or a single-layer type photosensitive layer. The multi-layer type photosensitive layer includes a charge generating layer that contains the charge generating material and a charge transport layer that contains the charge transport material and the binder resin, and in which the charge transport layer is located on the charge generating layer. The single-layer type photosensitive layer contains the charge generating material, the charge transport material, and the (Continued)

binder resin. The charge transport material is an enamine derivative represented by general formula (1). In general formula (1), $R_1$, $R_2$, l, m, and n are each as defined in the specification.

(1)

4 Claims, 2 Drawing Sheets

(58) Field of Classification Search
USPC ..... 430/73
See application file for complete search history.

(56) References Cited

FOREIGN PATENT DOCUMENTS

| | | | |
|---|---|---|---|
| JP | 2012-128355 | A | 7/2012 |
| JP | 2013-056905 | A | 3/2013 |

* cited by examiner

ELECTROPHOTOGRAPHIC PHOTOSENSITIVE MEMBER

INCORPORATION BY REFERENCE

The present application claims priority under 35 U.S.C. §119 to Japanese Patent Application No. 2014-154163, filed Jul. 29, 2014. The contents of this application are incorporated herein by reference in their entirety.

BACKGROUND

The present disclosure rerates to electrophotographic photosensitive members.

Electrophotographic photosensitive members are used as image bearing members in electrophotographic printers and multifunction peripherals. A typical electrophotographic photosensitive member includes a conductive substrate and a photosensitive layer located either directly or indirectly on the conductive substrate. A photosensitive member including a photosensitive layer that contains a charge generating material, a charge transport material, and a resin (organic material) for binding the aforementioned materials is referred to as an organic electrophotographic photosensitive member. An organic electrophotographic photosensitive member in which one layer implements a charge transport function by mainly containing a charge transport material and another layer implements a charge generation function by mainly containing a charge generating material is referred to as a multi-layer electrophotographic photosensitive member. An organic electrophotographic photosensitive member in which one layer includes both a charge transport material and a charge generating material, and thus in which the one layer implements both a charge transport function and a charge generation function, is referred to as a single-layer electrophotographic photosensitive member.

On the other hand, another example of a photosensitive member is an inorganic electrophotographic photosensitive member in which an inorganic material is used (for example, selenium or amorphous silicon). Advantages of organic electrophotographic photosensitive members as compared to inorganic electrophotographic photosensitive members are relatively small environmental effects and ease of photosensitive layer formation and are therefore currently in use in many image forming apparatuses.

Organic electrophotographic photosensitive member in which tris(4-styrylphenyl)amine derivatives are used as charge transport materials are commonly known.

SUMMARY

An electrophotographic photosensitive member according to the present disclosure includes a photosensitive layer containing a charge generating material, a charge transport material, and a binder resin. The photosensitive layer is a multi-layer type photosensitive layer or a single-layer type photosensitive layer. The multi-layer type photosensitive layer includes a charge generating layer that contains the charge generating material and a charge transport layer that contains the charge transport material and the binder resin, and in which the charge transport layer is located on the charge generating layer. The single-layer type photosensitive layer contains the charge generating material, the charge transport material, and the binder resin. The charge transport material is an enamine derivative represented by general formula (1).

(1)

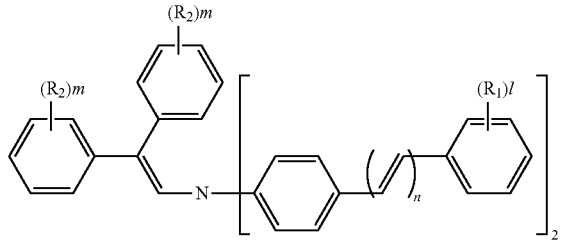

In general formula (1), $R_1$ and $R_2$ each represent, independently of one another, at least one chemical group selected from the group consisting of a halogen atom, an optionally substituted alkyl group having a carbon number of at least 1 and no greater than 6, an optionally substituted alkoxy group having a carbon number of at least 1 and no greater than 6, and an optionally substituted aryl group having a carbon number of at least 6 and no greater than 12. In general formula (1), in addition, l and m each represent, independently of one another, an integer of at least 0 and no greater than 4, and n represents an integer of at least 1 and no greater than 3.

DETAILED DESCRIPTION

Figure 1A:
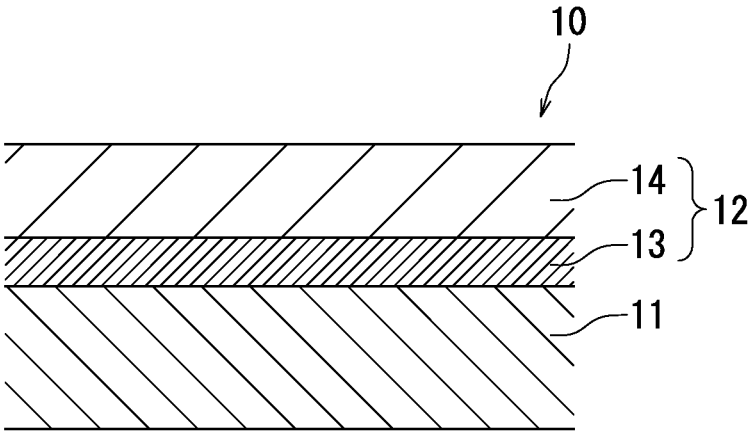
FIGS. 1A and 1B are each a rough cross-sectional illustration of structure of a multi-layer electrophotographic photosensitive member according to an embodiment of the present disclosure.

The following explains an embodiment of the present disclosure in detail. The present disclosure is of course not in any way limited by the following embodiment and appropriate alterations may be made in practice within the intended scope of the present disclosure. Note that although explanation is omitted in some places in order to avoid repetition, such omission does not limit the essence of the present disclosure.

In the present description the term "-based" may be appended to the name of a chemical compound in order to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof. Also, the term "enamine derivative" is used as a generic name encompassing any enamine compound having a skeletal structure represented by the chemical formula "═C═C—N═".

An electrophotographic photosensitive member (hereinafter, may also be referred to simply as a "photosensitive member") according to the present embodiment includes a photosensitive layer. The photosensitive layer contains a charge generating material, a charge transport material, and a binder resin. The charge transport material is an enamine derivative represented by general formula (1) shown below (hereinafter, may also be referred to simply as "enamine derivative (1)".

(1)

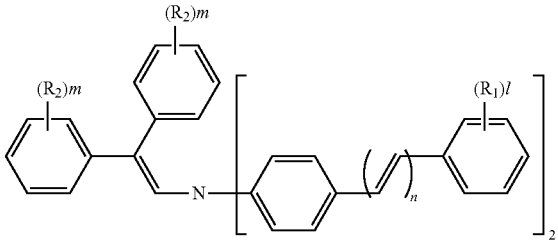

In general formula (1), $R_1$ and $R_2$ each represent, independently of one another, a chemical group selected from the group consisting of a halogen atom, an optionally substituted alkyl group having a carbon number of at least 1 and no greater than 6, an optionally substituted alkoxy group having a carbon number of at least 1 and no greater than 6, and an optionally substituted aryl group having a carbon number of at least 6 and no greater than 12. In general formula (1), in addition, l and m each represent, independently of one another, an integer of at least 0 and no greater than 4, and n represents an integer of at least 1 and no greater than 3.

The photosensitive layer is either a multi-layer type photosensitive layer or a single-layer type photosensitive layer. In other words, the photosensitive member according to the present embodiment may be a so-called multi-layer photosensitive member that includes a multi-layer type photosensitive layer. The multi-layer type photosensitive layer includes at least a charge generating layer and a charge transport layer. The charge transport layer is located on the charge generating layer. The charge generating layer contains at least a charge generating material. The charge transport layer contains a charge transport material and a binder resin.

The photosensitive member according to the present embodiment may alternatively be a so-called single-layer photosensitive member that includes a single-layer type photosensitive layer. The single-layer type photosensitive layer contains at least a charge generating material, a charge transport material, and a binder resin in the same layer.

<Multi-Layer Photosensitive Member>

Figure 1B:
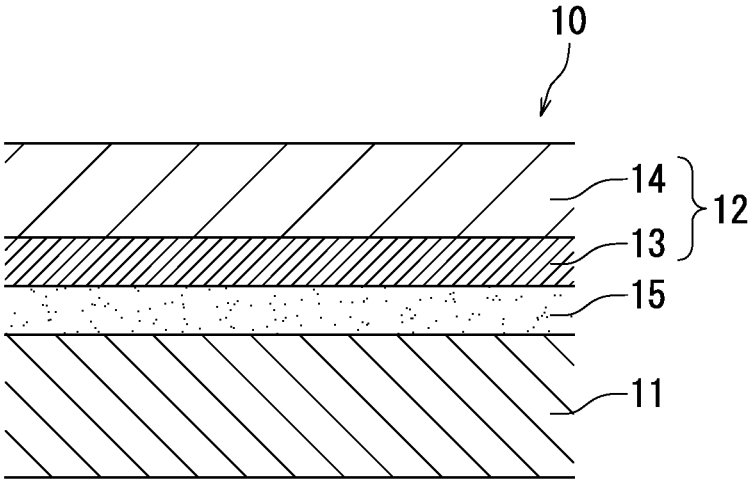

The following explains a multi-layer photosensitive member 10 including a multi-layer type photosensitive layer 12 with reference to FIGS. 1A and 1B. As illustrated in FIG. 1A, the multi-layer photosensitive member 10 includes a conductive substrate 11 and the multi-layer type photosensitive layer 12. The multi-layer type photosensitive layer 12 includes a charge generating layer 13 and a charge transport layer 14. The charge generating layer 13 is located on the conductive substrate 11. The charge transport layer 14 is located on the charge generating layer 13. As a result of the charge transport layer 14 being located on the charge generating layer 13, abrasion resistance of the multi-layer type photosensitive layer 12 can be improved while also maintaining excellent electrical properties of the multi-layer type photosensitive layer 12.

The charge generating layer 13 contains a charge generating material. The charge transport layer 14 contains a charge transport material and a binder resin.

No particular limitations are placed on the multi-layer photosensitive member 10 other than including the multi-layer type photosensitive layer 12. For example, an intermediate layer 15 may be present between the conductive substrate 11 and the multi-layer type photosensitive layer 12 as illustrated in FIG. 1B.

No particular limitations are placed on thickness of the charge generating layer 13 and the charge transport layer 14 so long as the thicknesses thereof are sufficient to enable the charge generating layer 13 and the charge transport layer 14 to implement the respective functions thereof. More specifically, the charge generating layer 13 preferably has a thickness of at least 0.01 μm and no greater than 5 μm, and more preferably at least 0.1 μm and no greater than 3 μm. Also, the charge transport layer 14 preferably has a thickness of at least 2 μm and no greater than 100 μm, and more preferably at least 5 μm and no greater than 50 μM.

<Single-Layer Photosensitive Member>

Figure 2A:
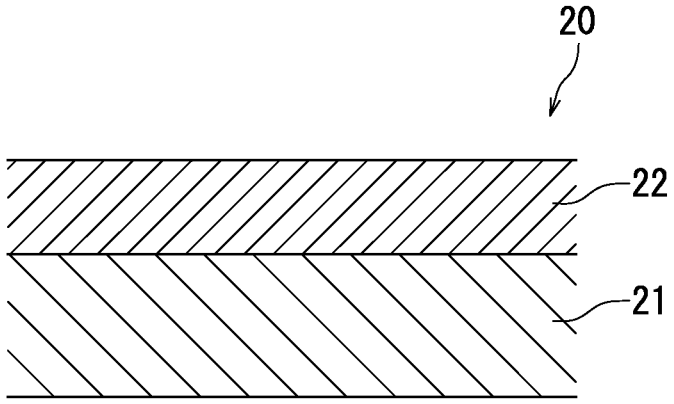
FIGS. 2A and 2B are each a rough cross-sectional illustration of structure of a single-layer electrophotographic photosensitive member according to an embodiment of the present disclosure.
Figure 2B:
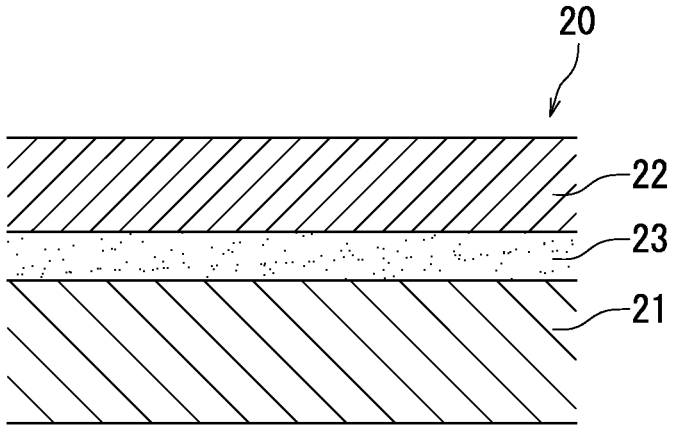

The following explains a single-layer photosensitive member 20 including a single-layer type photosensitive layer 22 with reference to FIGS. 2A and 2B. As illustrated in FIG. 2A, the single-layer photosensitive member 20 includes a conductive substrate 21 and the single-layer type photosensitive layer 22. The single-layer type photosensitive layer 22 is located on the conductive substrate 21. The single-layer type photosensitive layer 22 contains a charge generating material, a charge transport material, and a binder resin.

No particular limitations are placed on the single-layer photosensitive member 20 other than including the single-layer type photosensitive layer 22. More specifically, for example, the single-layer type photosensitive layer 22 may be located directly on the substrate 21 as illustrated in FIG. 2A. Alternatively, an intermediate layer 23 may be present between the conductive substrate 21 and the single-layer type photosensitive layer 22 as illustrated in FIG. 2B.

No particular limitations are placed on thickness of the single-layer type photosensitive layer 22 so long as the thickness thereof is sufficient to enable the single-layer type photosensitive layer to implement the function thereof. More specifically, the single-layer type photosensitive layer 22 preferably has a thickness of at least 5 μm and no greater than 100 μm, and more preferably at least 10 μm and no greater than 50 μm.

In the photosensitive member according to the present embodiment (single-layer photosensitive member 20 or multi-layer photosensitive member 10), the photosensitive layer (single-layer type photosensitive layer 22 or multi-layer type photosensitive layer 12) is preferably an outermost layer in order to inhibit occurrence of image deletion and restrict production costs. Also, in the multi-layer photosensitive member 10, among the layers of the multi-layer type photosensitive layer 12, the charge transport layer 14 is preferably an outermost layer (i.e., a surface layer). Through the above, the single-layer photosensitive member 20 and the multi-layer photosensitive member 10 have been explained with reference to FIGS. 1A, 1B, 2A, and 2B.

<Common Elements>

The following explains elements of configuration that are common to both the single-layer photosensitive member and the multi-layer photosensitive member.

[Conductive Substrate]

In the present embodiment, no particular limitations are placed on the conductive substrate other than at least a surface portion of the conductive substrate being conductive. More specifically, the conductive substrate may be formed from a conductive material. Alternatively, the conductive substrate may be formed through coating or vapor deposition of a conductive material on the surface of a plastic material or glass. Examples of conductive materials that can be used include metals such as aluminum, iron, copper, tin, platinum, silver, vanadium, molybdenum, chromium, cadmium, titanium, nickel, palladium, indium, stainless steel, and brass, and alloys of the aforementioned metals. Any one of the conductive materials listed above may be used or a combination of any two or more of the conductive materials listed above may be used.

Among the conductive substrates listed as examples above, use of a conductive substrate containing aluminum or aluminum alloy is preferable. The reasoning for the above is that use of such a conductive substrate enables provision of a photosensitive member having good movement of charge from the photosensitive layer to the conductive substrate and that can be used to form images with better image quality.

No particular limitations are placed on the shape of the conductive substrate which may be selected as appropriate. The conductive substrate may for example be sheet-shaped or drum-shaped. The conductive substrate preferably has sufficient mechanical strength during use.

[Charge Generating Material]

No particular limitations are placed on the charge generating material other than being a charge generating material that can be used in photosensitive members. Examples of charge generating materials that can be used include phthalocyanine-based pigments, perylene pigments, bisazo pigments, dithioketopyrrolopyrrole pigments, metal-free naphthalocyanine pigments, metal naphthalocyanine pigments, squaraine pigments, tris-azo pigments, indigo pigments, azulenium pigments, cyanine pigments, powders of inorganic photoconductive materials (for example, selenium, selenium-tellurium, selenium-arsenic, cadmium sulfide, or amorphous silicon), pyrylium salts, anthanthrone-based pigments, triphenylmethane-based pigments, threne pigments, toluidine-based pigments, pyrazoline-based pigments, and quinacridone-based pigments Any one charge generating material or a combination of two or more charge generating materials that is absorptive with respect to light in a desired wavelength region may be used. For example, in a digital optical image forming apparatus (for example, a laser beam printer or facsimile machine that uses a light source such as a semiconductor laser), a photosensitive member that is sensitive to a region of wavelengths of at least 700 nm is preferably used. Therefore, a phthalocyanine-based pigment (for example, metal-free phthalocyanine or titanyl phthalocyanine) is preferably used. Note that the phthalocyanine-based pigment is not limited to having a specific crystal structure and phthalocyanine-based pigments having various different crystal structures can be used. Examples of the crystal structure of the phthalocyanine-based pigment include an X-form crystal structure and a Y-form crystal structure. In order to improve electrical properties of the photosensitive member having a photosensitive layer containing the enamine derivative (1) as the charge transport material, use of a metal-free phthalocyanine having an X-form crystal structure (which may be hereinafter referred to as "X-form metal-free phthalocyanine") or a titanyl phthalocyanine having a Y-form crystal structure (which may be hereinafter referred to as "Y-form titanyl phthalocyanine") is preferable, and use of a Y-form titanyl phthalocyanine is more preferable.

A photosensitive member included in an image forming apparatus that uses a short-wavelength laser light source (for example, a laser light source having an approximate wavelength of at least 350 nm and no greater than 550 nm) preferably contains an anthanthrone-based pigment or a perylene-based pigment as a charge generating material.

The amount of the charge generating material in the multi-layer photosensitive member is preferably at least 5 parts by mass and no greater than 1,000 parts by mass relative to 100 parts by mass of a base resin contained in the charge generating layer, and more preferably at least 30 parts by mass and no greater than 500 parts by mass. Explanation of the base resin is provided further below.

The amount of the charge generating material in the single-layer photosensitive member is preferably at least 0.1 parts by mass and no greater than 50 parts by mass relative to 100 parts by mass of the binder resin, and more preferably at least 0.5 parts by mass and no greater than 30 parts by mass.

[Charge Transport Material]

In the present embodiment, the photosensitive layer contains a charge transport material. The charge transport material is more specifically a hole transport material.

(Hole Transport Material)

In the present embodiment, the hole transport material contained in the photosensitive member is the enamine derivative (1).

The enamine derivative (1) has an enamine part (═C═C—N═) and a double bond and therefore tends to have excellent properties in terms of solvent solubility. As a result, the photosensitive layer containing the enamine derivative (1) is less likely to undergo crystallization during photosensitive layer formation. In addition, the enamine derivative (1) is thought to be dispersed uniformly in the photosensitive layer. In addition, the expansion of pi ($\pi$) electrons is adjusted to an appropriate level, which is thought to improve charge transport efficiency of the photosensitive layer. As described above, a photosensitive layer containing the enamine derivative (1) as a charge transport material therefore exhibits excellent electrical properties.

Examples of halogen atoms that may be represented by $R_1$ and $R_2$ in general formula (1) include fluorine (fluoro group), chlorine (chloro group), and bromine (bromo group).

Examples of alkyl groups having a carbon number of at least 1 and no greater than 6 that may be represented by $R_1$ and $R_2$ in general formula (1) include a methyl group, an ethyl group, a propyl group, an isopropyl group, an n-butyl group, an s-butyl group, a t-butyl group, a pentyl group, an isopentyl group, a neopentyl group, and a hexyl group.

Examples of alkoxy groups having a carbon number of at least 1 and no greater than 6 that may be represented by $R_1$ and $R_2$ in general formula (1) include an ethoxy group, an n-propoxy group, an isopropoxy group, an n-butoxy group, an s-butoxy group, a t-butoxy group, a pentyloxy group, an isopentyloxy group, a neopentyloxy group, and a hexyloxy group.

Examples of aryl groups having a carbon number of at least 6 and no greater than 12 that may be represented by $R_1$ and $R_2$ in general formula (1) include a phenyl group and a naphthyl group. Aryl groups having a carbon number of at least 6 and no greater than 12 that may be represented by $R_1$ and $R_2$ in general formula (1) may optionally have substituents such as described further below. Examples of substituted aryl groups having a carbon number of at least 6 and no greater than 12 include aryl groups having a carbon number of at least 6 and no greater than 12 and having at least one and no greater than 3 alkyl groups that each has a carbon number of at least 1 and no greater than 6. Specific examples include a tolyl group, a xylyl group, and a mesityl group.

Alkyl groups having a carbon number of at least 1 and no greater than 6 and alkoxy groups that having a carbon number of at least 1 and no greater than 6 that may be represented by $R_1$ and $R_2$ in general formula (1) may optionally have substituents. No particular limitations are placed on possible substituents, but examples thereof include alkoxy groups having a carbon number of at least 1 and no greater than 6, and aryl groups having a carbon number of at least 6 and no greater than 12. Aryl groups having a carbon number of at least 6 and no greater than 12 that may be represented by $R_1$ and $R_2$ in general formula (1) may optionally have substituents. No particular limitations are placed on possible substituents, but examples thereof include alkyl groups having a carbon number of at least 1 and no greater than 6, alkoxy groups having a carbon number of at least 1 and no greater than 6, and aryl groups having a carbon number of at least 6 and no greater than 12. Alkyl groups having a carbon number of at least 1 and no greater than 6 that may be substituents are the same as alkyl groups having a carbon number of at least 1 and no greater than 6 that may be represented by $R_1$ and $R_2$ in general formula (1). Alkoxy groups having a carbon number of at least 1 and no greater than 6 that may be substituents are the same as alkoxy groups having a carbon number of at least 1 and no greater than 6 be represented by $R_1$ and $R_2$ in general formula (1). Aryl groups having a carbon number of at least 6 and no greater than 12 that may be substituents are the same as aryl groups having a carbon number of at least 6 and no greater than 12 that may be represented by $R_1$ and $R_2$ in general formula (1).

In the general formula (1), l and m each represent, independently of one another, an integer of at least 0 and no greater than 4. When l represents an integer greater than 1, chemical groups $R_1$ bonded to the same aromatic ring may be the same or different to one another.

When m represents an integer greater than 1, chemical groups $R_2$ bonded to the same aromatic ring may be the same or different to one another. In order to facilitate understanding, an example is explained in which m represents 2 and in which two chemical groups $R_2$ bonded to the same aromatic ring (phenyl group) are bonded to the aromatic ring at an ortho position and a meta position. In such a situation, the ortho position $R_2$ and the meta position $R_2$ bonded to the same aromatic ring may be the same or different to one another. However, in the above situation, the ortho position $R_2$ is the same for each of the two aromatic rings. Also, in the above situation, the meta position $R_2$ is the same for each of the two aromatic rings.

In the general formula (1), n represents an integer of at least 1 and no greater than 3.

From a standpoint of particularly excellent electrical properties in a photosensitive member to be obtained, $R_1$ and $R_2$ in general formula (1) is preferably an alkyl group having a carbon number of at least 1 and no greater than 6 or an alkoxy group having a carbon number of at least 1 and no greater than 6, and is more preferably a methyl group or a methoxy group (alkyl group or alkoxy group having a carbon of 1).

From a standpoint of particularly excellent electrical properties in a photosensitive member to be obtained, in the general formula (1), l preferably represents 0 or 1, m preferably represents 0 or 1, and n preferably represents an integer of at least 1 and no greater than 3.

From a standpoint of particularly excellent electrical properties in a photosensitive member to be obtained, preferable examples of a compound (1) include compounds represented by general formula (1) where l represents 1.

From a standpoint of particularly excellent electrical properties in a photosensitive member to be obtained, other preferable examples of the compound (1) include compounds represented by general formula (1) where n represents 2 or 3.

From a standpoint of particularly excellent electrical properties in a photosensitive member to be obtained, additional preferable examples of the compound (1) also include compounds represented by general formula (1) where l represents 0, m represents 0, and n represents 3.

Specific examples of the enamine derivative (1) include enamine derivatives represented by formulae (HT-1) to (HT-6) shown below. The enamine derivatives represented by formulae (HT-1) to (HT-6) may be referred to below as enamine derivatives (HT-1) to (HT-6).

(HT-1)

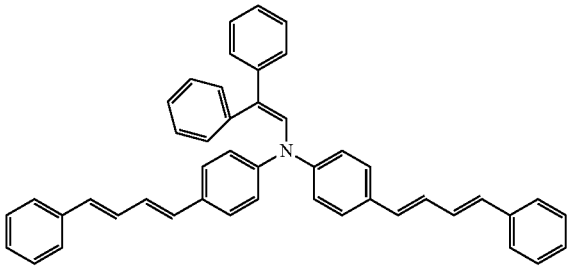

(HT-2)

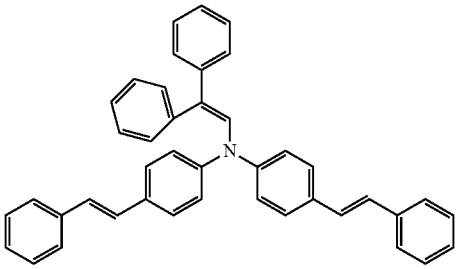

(HT-3)

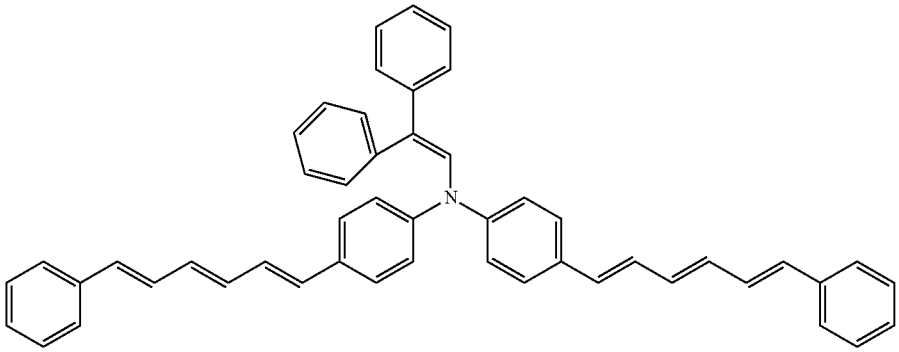

-continued (HT-4)

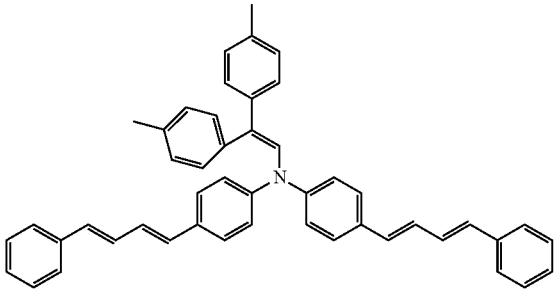

(HT-5)

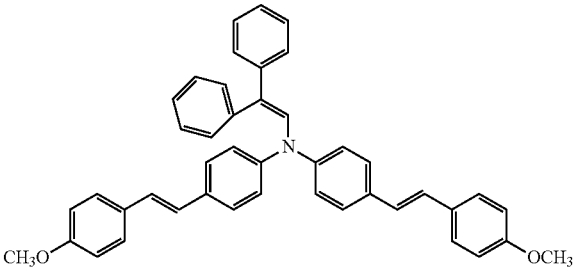

(HT-6)

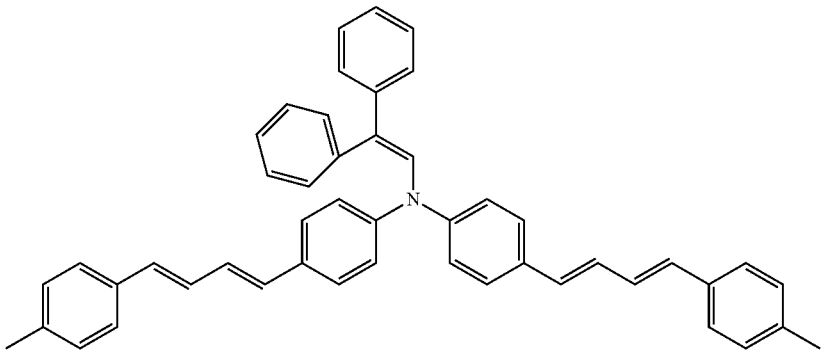

The amount of the hole transport material (charge transport material) in the multi-layer photosensitive member is preferably at least 10 parts by mass and no greater than 200 parts by mass relative to 100 parts by mass of binder resin, and more preferably at least 20 parts by mass and no greater than 100 parts by mass.

The amount of the hole transport material (charge transport material) in the single-layer photosensitive member is preferably at least 10 parts by mass and no greater than 200 parts by mass relative to 100 parts by mass of binder resin, and more preferably at least 10 parts by mass and no greater than 100 parts by mass.

[Electron Acceptor Compound]

The photosensitive layer may optionally contain an electron acceptor compound depending on necessity thereof. Inclusion of the electron acceptor compound is effective, particularly in the single-layer type photosensitive layer, in enabling transport of electrons and providing bipolar properties. In short, the electron acceptor compound in the single-layer type photosensitive layer functions as an electron transport material. On the other hand, inclusion of the electron acceptor compound in the multi-layer type photosensitive layer can improve hole transport by the hole transport material.

Examples of electron acceptor compounds that can be used include quinone-based compounds (naphthoquinone-based compounds, diphenoquinone-based compounds, anthraquinone-based compounds, azoquinone-based compounds, nitroanthraquinone-based compounds, and dinitroanthraquinone-based compounds), malononitrile-based compounds, thiopyran-based compounds, trinitrothioxanthone-based compounds, 3,4,5,7-tetranitro-9-fluorenone-based compounds, dinitroanthracene-based compounds, dinitroacridine-based compounds, tetracyanoethylene, 2,4,8-trinitrothioxanthone, dinitrobenzene, dinitroanthracene, dinitroacridine, succinic anhydride, maleic anhydride, and dibromomaleic anhydride. Any one of the electron acceptor compounds listed above may be used or a combination of any two or more of the electron acceptor compounds listed above may be used.

The amount of the electron acceptor compound in the multi-layer photosensitive member is preferably at least 0.1 parts by mass and no greater than 20 parts by mass relative to 100 parts by mass of the binder resin, and more preferably at least 0.5 parts by mass and no greater than 10 parts by mass.

The amount of the electron acceptor compound in the single-layer photosensitive member is preferably at least 5 parts by mass and no greater than 100 parts by mass relative to 100 parts by mass of the binder resin, and more preferably at least 10 parts by mass and no greater than 80 parts by mass.

[Resin]

(Base Resin)

The charge generating layer of the multi-layer photosensitive member contains a charge generating layer binder resin (also referred to as a base resin).

No particular limitations are placed on the base resin other than being a resin that can be used in a charge generating layer of a multi-layer photosensitive member.

The charge generating layer and the charge transport layer of the multi-layer photosensitive member are typically formed in stated order. Therefore, the base resin used in the multi-layer photosensitive member preferably differs from the binder resin in order that the base resin does not dissolve in a solvent of an application liquid used during formation of the charge transport layer.

Specific examples of base resins that can be used include styrene-butadiene copolymers, styrene-acrylonitrile copolymers, styrene-maleate copolymers, acrylic copolymers, styrene-acrylate copolymers, polyethylene resins, ethylene-vinyl acetate copolymers, chlorinated polyethylene resins, polyvinyl chloride resins, polypropylene resins, ionomer resins, vinyl chloride-vinyl acetate copolymers, alkyd resins, polyamide resins, polyurethane resins, polysulfone resins, diallyl phthalate resins, ketone resins, polyvinyl acetal resins, polyvinyl butyral resins, polyether resins, silicone resins, epoxy resins, phenolic resins, urea resins, melamine resins, epoxy acrylate resins (acrylic acid adduct of epoxy compound), and urethane-acrylate resins (acrylic acid adduct of urethane compound). A specific example of a preferable base resin is polyvinyl butyral. Any one of the base resins listed above may be used or a combination of any two or more of the base resins listed above may be used.

(Binder Resin)

The single-layer type photosensitive layer of the single-layer photosensitive member or the charge transport layer of the multi-layer photosensitive member may contain a binder resin. Examples of binder resins that can be used include thermoplastic resins (polycarbonate resins, styrene-based resins, styrene-butadiene copolymers, styrene-acrylonitrile copolymers, styrene-maleate copolymers, styrene-acrylate copolymers, acrylic copolymers, polyethylene resins, ethylene-vinyl acetate copolymers, chlorinated polyethylene resins, polyvinyl chloride resins, polypropylene resins, ionomers, vinyl chloride-vinyl acetate copolymers, alkyd resins, polyamide resins, polyurethane resins, polyarylate resins, polysulfone resins, diallyl phthalate resins, ketone resins, polyvinyl butyral resins, polyether resins, and polyester resins), thermosetting resins (silicone resins, epoxy resins, phenolic resins, urea resins, melamine resins, and other crosslinkable thermosetting resins), and photocurable resins (epoxy acrylate resins (acrylic acid adduct of epoxy compound) and urethane-acrylate resins (acrylic acid adduct of urethane compound)). Any one of the binder resins listed above may be used or a combination of any two or more of the binder resins listed above may be used.

In terms of molecular weight, the binder resin preferably has a viscosity average molecular weight of at least 40,000, and more preferably at least 40,000 and no greater than 52,500. If the molecular weight of the binder resin is too low, the binder resin may have insufficient abrasion resistance and as a consequence abrasion of the charge transport layer or the single-layer type photosensitive layer may have a high tendency to occur. On the other hand, if the molecular weight of the binder resin is too large, formation of the charge transport layer or single-layer type photosensitive layer tends to be difficult due to the binder resin having a low tendency to dissolve in a solvent during formation of the charge transport layer or the single-layer type photosensitive layer.

[Additives]

In the photosensitive member according to the present embodiment, various additives may be contained in one or more of the multi-layer type photosensitive layer (the charge generating layer and the charge transport layer), the single-layer type photosensitive layer, and the intermediate layer, so long as such additives do not adversely affect electrophotographic properties of the photosensitive member. Examples of additives that can be used include antidegradants (antioxidants, radical scavengers, singlet quenchers, and ultraviolet absorbing agents), softeners, surface modifiers, extenders, thickeners, dispersion stabilizers, waxes, acceptors, donors, surfactants, plasticizers, sensitizers, and leveling agents. Examples of preferable antioxidants include hindered phenols, hindered amines, paraphenylenediamine, arylalkanes, hydroquinones, spirochromanes, and spiroindanones, as well as derivatives, organosulfur compounds, and organophosphorous compounds of any of the above compounds.

[Intermediate Layer]

The photosensitive member according to the present embodiment may optionally include an intermediate layer (for example, an underlayer). In the single-layer photosensitive member, the intermediate layer is present between the conductive substrate and the single-layer type photosensitive layer. In the multi-layer photosensitive member, the intermediate layer is present between the conductive substrate and the charge generating layer. The intermediate layer for example contains inorganic particles and a resin for intermediate layer use (intermediate layer resin). Provision of the intermediate layer may facilitate flow of electric current generated when the photosensitive member is exposed to light and inhibit increasing resistance, while also maintaining insulation to a sufficient degree so as to inhibit occurrence of leakage current.

Examples of inorganic particles that can be used includes particles of metals (for example, aluminum, iron, and copper), particles of metal oxides (for example, titanium oxide, alumina, zirconium oxide, tin oxide, and zinc oxide), and particles of non-metal oxides (for example, silica). Any one type of inorganic particles listed above may be used or a combination of any two or more types of inorganic particles listed above may be used.

No particular limitations are placed on the intermediate layer resin other than being a resin that can be used to form an intermediate layer.

<Photosensitive Member Production Method>

The following explains a production method for the single-layer photosensitive member. The single-layer photosensitive member is produced by applying an application liquid for single-layer type photosensitive layer formation (first application liquid) onto a conductive substrate and drying the first application liquid thereon. The first application liquid is prepared by dissolving or dispersing a charge generating material, a charge transport material (hole transport material), a binder resin, and additive components (for example, an electron acceptor compound, and various additives), depending on necessity thereof, in a solvent.

The following explains a production method for the multi-layer photosensitive member.

Specifically, an application liquid for charge generating layer formation (second application liquid) and an application liquid for charge transport layer formation (third application liquid) are first prepared. The second application liquid is applied onto a conductive substrate and dried thereon by an appropriate method to form a charge generating layer. After formation of the charge generating layer, the third application liquid is applied onto the charge generating layer and dried thereon to form a charge transport layer. Through the above process, the multi-layer photosensitive member is produced.

The second application liquid is prepared by dissolving or dispersing a charge generating material, a base resin, and additive components (for example, various additives), depending on necessity thereof, in a solvent. The third application liquid is prepared by dissolving or dispersing a charge transport material, a binder resin, and additive components (for example, an electron acceptor compound, and various additives), depending on necessity thereof, in a solvent.

No particular limitations are placed on the solvents contained in the application liquids (first application liquid, second application liquid, and third application liquid) other than that the components of each of the application liquids should be soluble or dispersible in the solvent. Specific examples of solvents that can be used include alcohols (methanol, ethanol, isopropanol, and butanol), aliphatic hydrocarbons (n-hexane, octane, and cyclohexane), aromatic hydrocarbons (benzene, toluene, and xylene), halogenated hydrocarbons (dichloromethane, dichloroethane, carbon tetrachloride, and chlorobenzene), ethers (dimethyl ether, diethyl ether, tetrahydrofuran, ethylene glycol dimethyl ether, and diethylene glycol dimethyl ether), ketones (acetone, methyl ethyl ketone, and cyclohexanone), esters (ethyl acetate and methyl acetate), dimethyl formaldehyde, dimethyl formamide, and dimethyl sulfoxide. Any one of the solvents listed above may be used or a combination of any two or more of the solvents listed above may be used. In order to improve workability for operators in production of the photosensitive member, a non-halogenated solvent (i.e., a solvent other than a halogenated hydrocarbon) is preferably used.

Each of the application liquids is prepared by dissolving the components in order to disperse the components in the solvent. Mixing or dispersion can for example be performed using a bead mill, a roll mill, a ball mill, an attritor, a paint shaker, or an ultrasonic disperser.

The application liquid may for example further contain a surfactant in order to improve dispersibility of the components.

No particular limitations are placed on the method by which the application liquid is applied so long as the method enables uniform application of an application liquid onto a conductive substrate. Examples of application methods that can be used include dip coating, spray coating, spin coating, and bar coating.

No particular limitations are placed on the method by which the application liquid is dried other than being a method for evaporating a solvent contained in an application liquid. The method of drying may for example be heat treatment (hot-air drying) using a high-temperature dryer or a reduced pressure dryer. The heat treatment is for example performed for at least 3 minutes and no greater than 120 minutes at a temperature of at least 40° C. and no greater than 150° C.

Through the above, the photosensitive member according to the present embodiment has been explained. The photosensitive member according to the present embodiment exhibits excellent electrical characteristics while inhibiting crystallization in the photosensitive layer. A photosensitive member such as described in the present embodiment is thought to enable image formation with high image quality over an extended period of time.

EXAMPLES

The following provides more specific explanation of the present disclosure through use of Examples. Note that the present disclosure is not in any way limited to the scope of the examples.

(1) Enamine Derivative Synthesis

Synthesis of Enamine Derivative (HT-1)

First, a reaction represented by reaction formula (R-1) shown below was carried out.

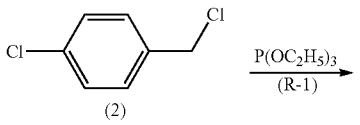

-continued

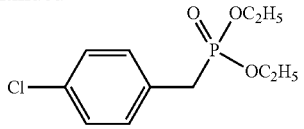

More specifically, 16.1 g (0.1 mol) of dibromobutene, which is a compound represented by formula (2), and 25.0 g (0.15 mol) of triethyl phosphite were added into a two-necked flask having a capacity of 200 mL. The contents of the flask were stirred for 8 hours while heating at 180° C. Next, the mixture in the flask was cooled to room temperature. Subsequently excess triethyl phosphite was evaporated under reduced pressure to yield 24.1 g of a phosphonate derivative (white liquid) represented by formula (3) (percentage yield: 92 mol %).

Next, a reaction represented by reaction formula (R-2) shown below was carried out.

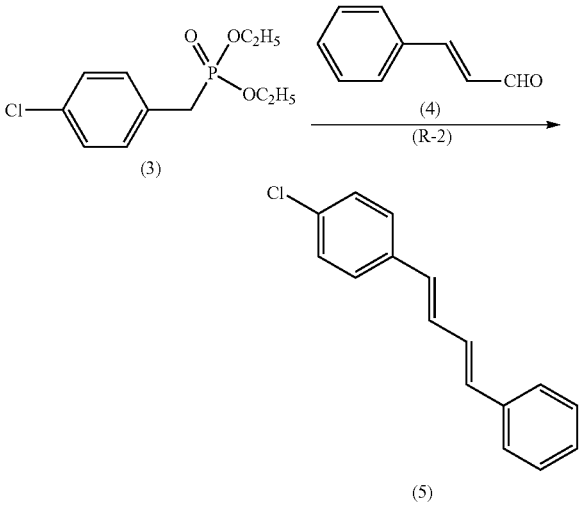

First, 13.0 g (0.05 mol) of the phosphonate derivative represented by formula (3) was added into a two-necked flask having a capacity of 500 mL kept at an internal temperature of 0° C., and gas in the flask was displaced with argon gas. Then, 100 mL of dried tetrahydrofuran (THF) and 9.3 g (0.05 mol) of methanol solution containing sodium methoxide (concentration: 28% by mass) were added into the flask and the flask contents were stirred for 30 minutes at 0° C. to carry out a reaction. To the resultant reaction liquid, a liquid mixture yielded by dissolving 7.0 g (0.05 mol) of a compound represented by formula (4) in 300 mL of dried THF was added. The contents of the flask were then stirred for 12 hours at room temperature to carry out a reaction (Wittig reaction).

After pouring the resultant mixture into ion exchanged water, extraction was performed using toluene to yield an organic phase (toluene phase). The organic phase was washed five times using ion exchanged water. Subsequently, the washed organic phase was dried with anhydrous sodium sulfate, and solvent was evaporated from the organic phase to yield a residue. Next, the residue was purified by silica gel column chromatography (developing solvent: solvent mixture of 20 mL of toluene and 100 mL of methanol) to yield 9.8 g of a compound represented by formula (5) (white crystals) (percentage yield: 80 mol %).

Subsequently, reactions represented by reaction formulae (R-3) and (R-4) shown below (coupling reaction) were carried out.

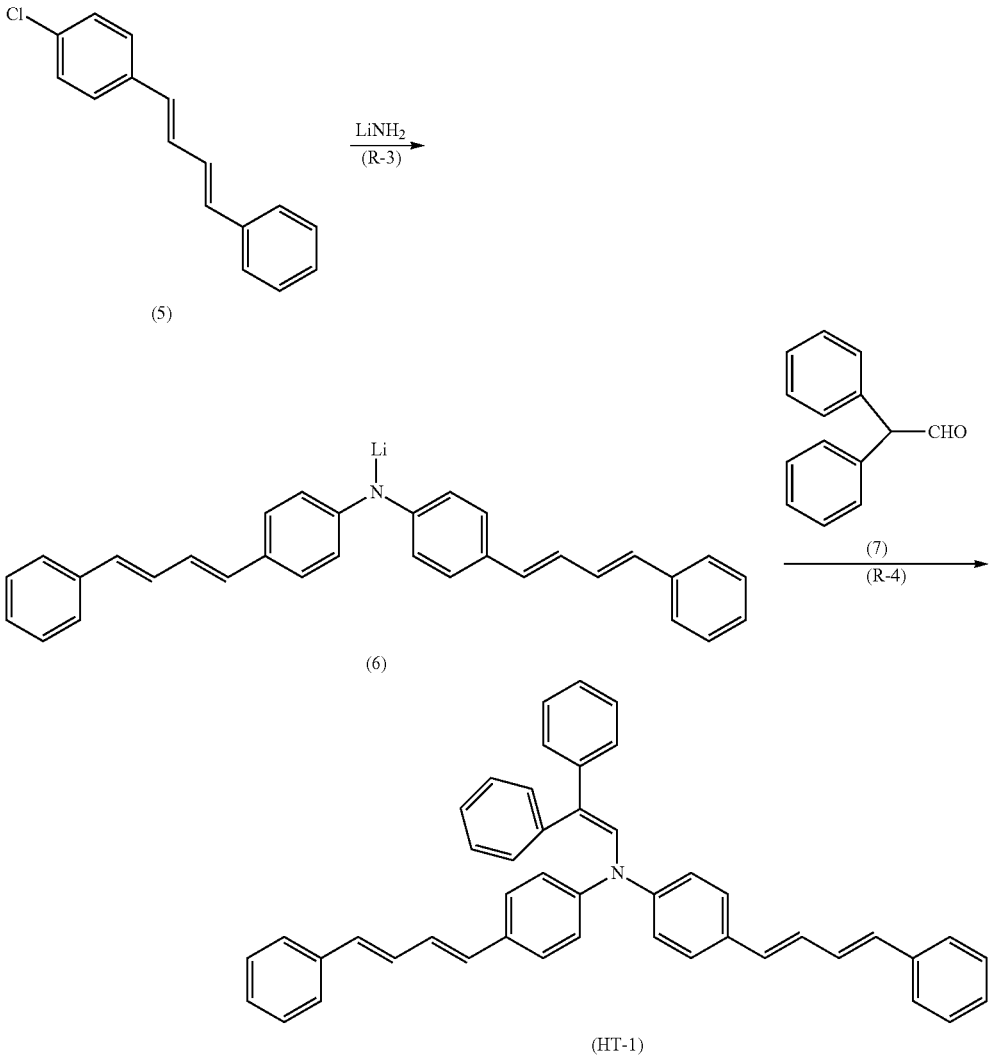

More specifically, to carry out the reaction represented by reaction formula (R-3), 6.0 g (0.02 mol) of the compound represented by formula (5), 0.0662 g (0.000189 mol) of tricyclohexylphosphine (Pcy3), 0.0864 g (0.0000944 mol) of tris(dibenzylideneacetone)dipalladium ($Pd_2(dba)_3$) as a palladium catalyst, 4.0 g (0.042 mol) of sodium tert-butoxide (t-BuONa), and 0.24 g (0.010 mol) of lithium amide were added into a three-necked flask having a capacity of 2 L that was equipped with a Dean-Stark trap. Next, 500 mL of distilled o-xylene was added into the flask. Then, gas in the flask was displaced with argon gas, and the contents of the flask were stirred at 120° C. to carry out the reaction for 5 hours.

After reaction, the reaction liquid (solution containing the reaction product and o-xylene) was cooled to room temperature to yield an organic phase. The organic phase was washed three times using ion exchanged water. Next, anhydrous sodium sulfate and activated clay were added to the organic phase in order to perform drying and adsorption treatment. After the drying and absorption treatment, o-xylene was evaporated under reduced pressure to yield a residue.

The residue was crystallized using a solvent mixture of chloroform and hexane to yield 2.6 g of an intermediate represented by formula (6) (intermediate of the enamine derivative (HT-1)).

Subsequently, a reaction represented by reaction formula (R-4) was carried out to synthesize the enamine derivative (HT-1) being the final product.

More specifically, 2.6 g (0.006 mol) of the intermediate represented by formula (6), 1.20 g (0.006 mol) of diphenylacetaldehyde represented by formula (7), and p-toluenesulfonic acid were added to a three-necked flask having a capacity of 2 L that was equipped with a Dean-Stark trap. Subsequently, 100 mL of toluene was further added into the flask. The contents of the flask were then stirred and refluxed at 120° C. to carry out the reaction for 5 hours.

Next, the reaction liquid was cooled to room temperature to yield an organic phase. The organic phase was washed three times using ion exchanged water, and anhydrous sodium sulfate and activated clay were added to the organic phase in order to perform drying and adsorption treatment. After the drying and adsorption treatment, toluene was evaporated under reduced pressure to yield a residue.

The residue was purified by silica gel column chromatography (developing solvent: solvent mixture of chloroform and hexane) to yield 4.1 g of the enamine derivative (HT-1) (percentage yield: 68 mol %).

Synthesis of Enamine Derivative (HT-2)

A reaction similar to the reaction represented by reaction formula (R-1) was carried out to yield the compound represented by formula (3).

Next, a compound represented by formula (8) shown below was used instead of the compound represented by formula (4) in order to carry out a reaction represented by reaction formula (R-5) shown below instead of the reaction represented by reaction formula (R-2). The reaction represented by reaction formula (R-5) was carried out in the same manner as the reaction represented by reaction formula (R-2) in all aspects other than that the compound represented by formula (8) was used instead of the compound represented by formula (4). As a result, a compound represented by formula (9) shown below was yielded (percentage yield: 85 mol %).

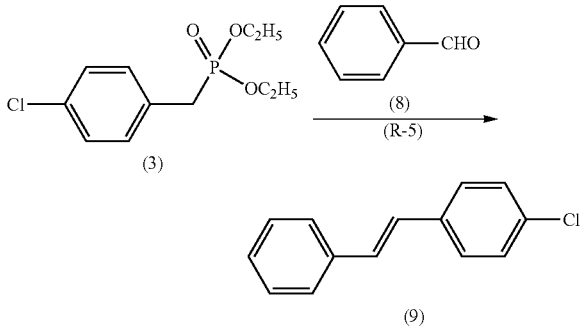

Next, the compound represented by formula (9) was used instead of the compound represented by formula (5) in order to carry out a reaction represented by reaction formula (R-6) shown below instead of the reaction represented by reaction formula (R-3). The reaction represented by reaction formula (R-6) was carried out in the same manner as the reaction represented by reaction formula (R-3) in all aspects other than that the compound represented by formula (9) was used instead of the compound represented by formula (5). As a result, an intermediate represented by formula (10) shown below was yielded.

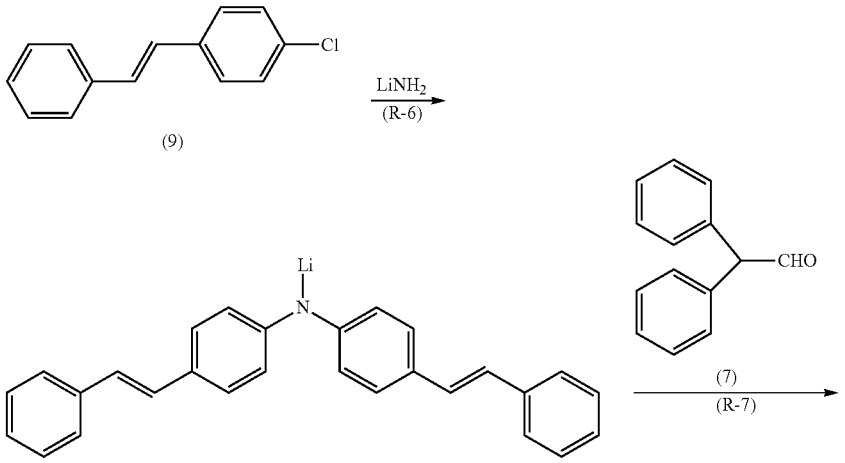

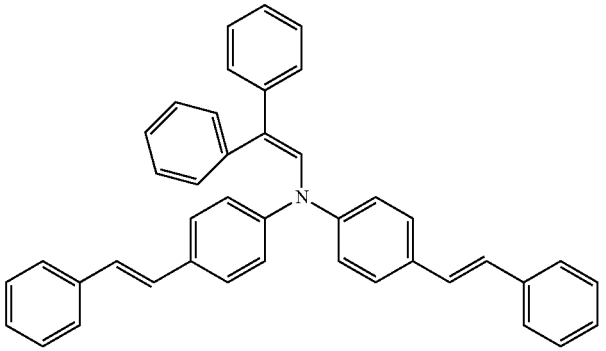

(HT-2)

Next, the intermediate represented by formula (10) was used instead of the intermediate represented by formula (6) in order to carry out a reaction represented by reaction formula (R-7) instead of the reaction represented by formula (R-4). The reaction represented by reaction formula (R-7) was carried out in the same manner as the reaction represented by reaction formula (R-4) in all aspects other than that the intermediate represented by formula (10) was used instead of the intermediate represented by formula (6). As a result, the enamine derivative (HT-2) was yielded (percentage yield: 70 mol %).

Note that in synthesis of the enamine derivative (HT-2), and also in synthesis of the enamine derivatives (HT-3) to (HT-6) described below, additive amounts of materials were adjusted in order that a molar scale in synthesis of each of the enamine derivatives (HT-2) to (HT-6) is the same as the molar scale in synthesis of the enamine derivative (HT-1).

Synthesis of Enamine Derivative (HT-3)

A compound represented by formula (11) shown below was used instead of the compound represented by the formula (2) in order to carry out a reaction represented by reaction (R-8) shown below instead of the reaction (R-1). The reaction represented by reaction formula (R-8) was carried out in the same manner as the reaction represented by reaction formula (R-1) in all aspects other than that the compound represented by formula (11) was used instead of the compound represented by formula (2). As a result, a phosphonate derivative represented by formula (12) shown below was yielded.

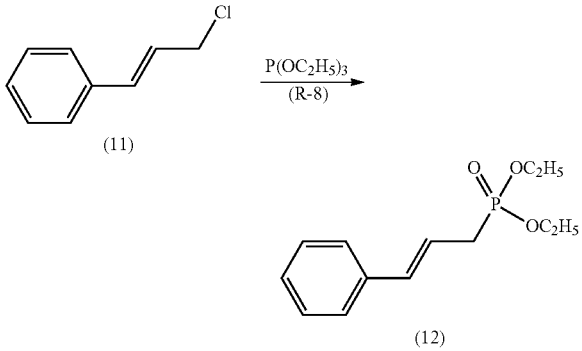

Next, the compound represented by formula (12) was used instead of the compound represented by formula (3) and a compound represented by formula (13) shown below was used instead of the compound represented by formula (4) in order to carry out a reaction represented by reaction formula (R-9) shown below instead of reaction represented by reaction formula (R-2). The reaction represented by reaction formula (R-9) was carried out in the same manner as the reaction represented by reaction formula (R-2) in all aspects other than that the compound represented by formula (12) was used instead of the intermediate represented by formula (3) and that the compound represented by formula (13) was used instead of the compound represented by formula (4). As a result, a compound represented by formula (14) shown below was yielded (percentage yield: 40 mol %).

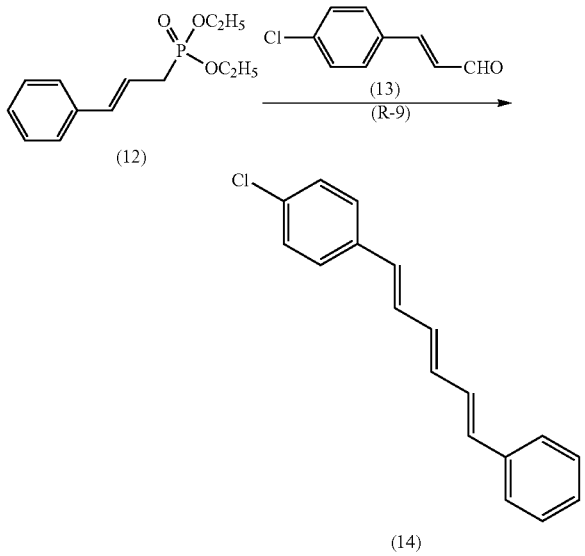

Next, the compound represented by formula (14) was used instead of the compound represented by formula (5) in order to carry out a reaction represented by reaction formula (R-10) shown below instead of the reaction represented by reaction formula (R-3). The reaction represented by reaction formula (R-10) was carried out in the same manner as the reaction represented by reaction formula (R-3) in all aspects other than that the compound represented by formula (14) was used instead of the intermediate represented by formula (5). As a result, an intermediate represented by formula (15) shown below was yielded.

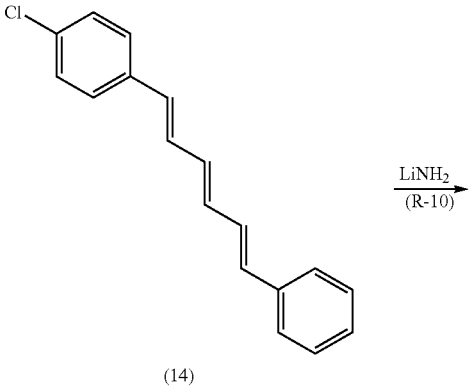

-continued

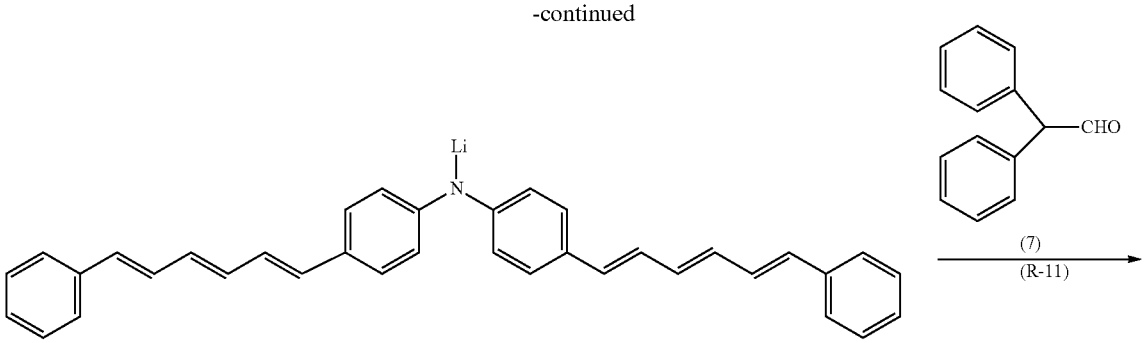

(15)

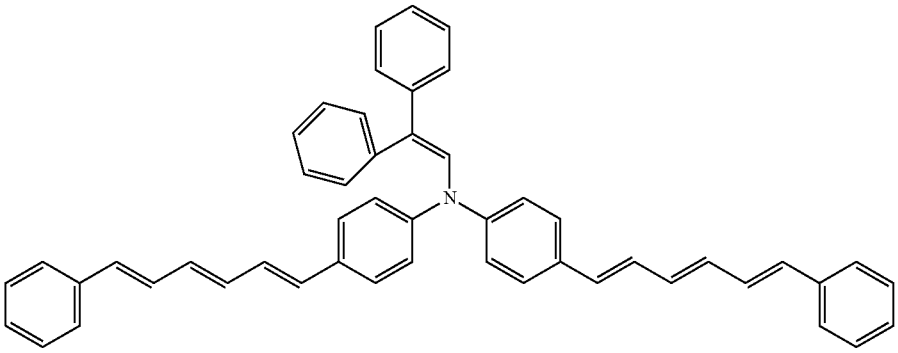

(HT-3)

Next, the intermediate represented by formula (15) was used instead of the intermediate represented by formula (6) in order to carry out a reaction represented by reaction formula (R-11) instead of the reaction represented by reaction formula (R-4). The reaction represented by reaction formula (R-11) was carried out in the same manner as the reaction represented by reaction formula (R-4) in all aspects other than that the compound represented by formula (15) was used instead of the intermediate represented by formula (6). As a result, the enamine derivative (HT-3) was yielded (percentage yield: 65 mol %).

Synthesis of Enamine Derivative (HT-4)

The reactions similar to those represented by reaction formulae (R-1) and (R-2) were carried out to yield the compound represented by formula (5).

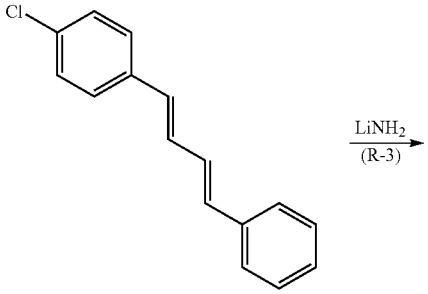

(5)

Subsequently, a reaction similar to that represented by reaction formula (R-3) was carried out to yield the intermediate represented by formula (6). Next, a compound represented by formula (16) shown below was used instead of the compound represented by formula (7) in order to carry out a reaction represented by reaction formula (R-12) shown below instead of the reaction represented by reaction formula (R-4). The reaction represented by reaction formula (R-12) was carried out in the same manner as the reaction represented by reaction formula (R-4) in all aspects other than that the compound represented by formula (16) was used instead of the intermediate represented by formula (7). As a result, the enamine derivative (HT-4) was yielded (percentage yield: 65 mol %).

-continued

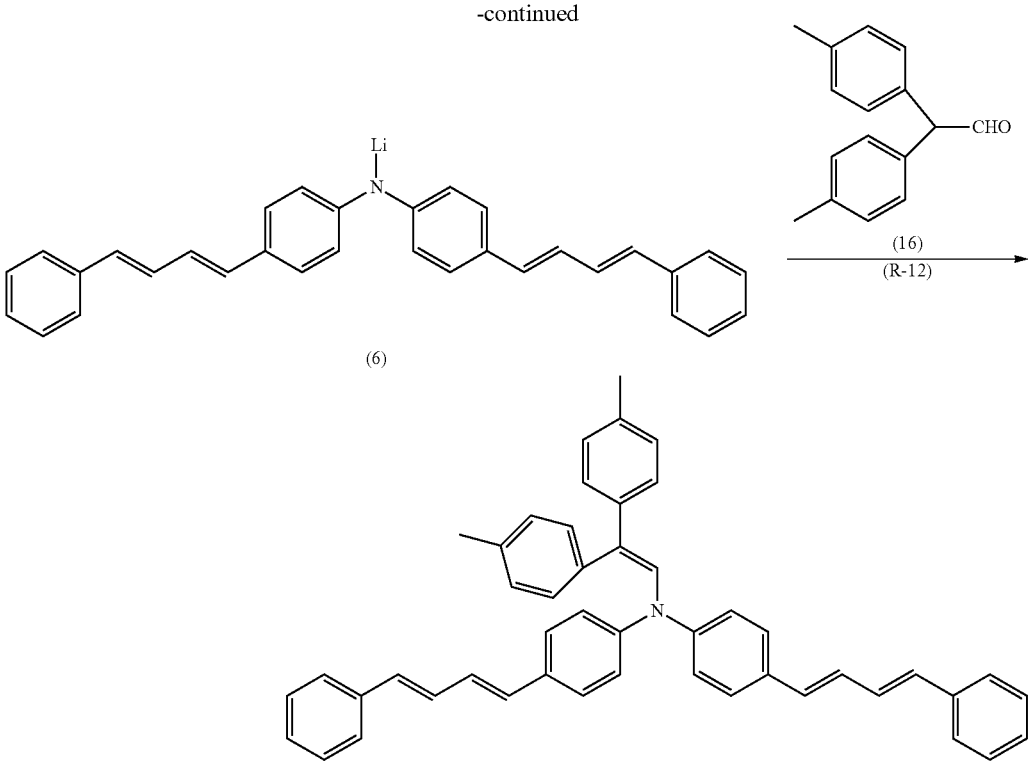

Synthesis of Enamine Derivative (HT-5)

A reaction similar to that represented by reaction formula (R-1) was carried out to yield the compound represented by formula (3).

Next, a compound represented by formula (17) shown below was used instead of the compound represented by formula (4) in order to carry out a reaction represented by reaction formula (R-13) shown below instead of the reaction represented by reaction formula (R-2). The reaction represented by reaction formula (R-13) was carried out in the same manner as the reaction represented by reaction formula (R-2) in all aspects other than that the compound represented by formula (17) was used instead of the compound represented by formula (4). As a result, a compound represented by formula (18) shown below was yielded.

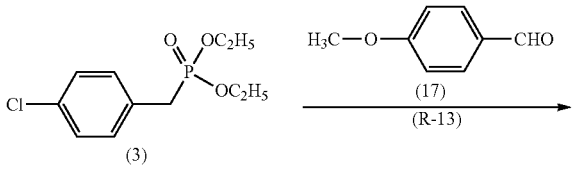

-continued

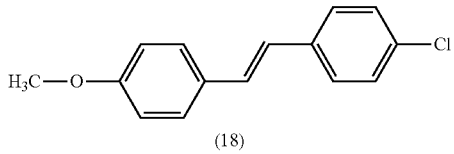

Next, the compound represented by formula (18) was used instead of the compound represented by formula (5) in order to carry out a reaction represented by reaction formula (R-14) shown below instead of the reaction represented by reaction formula (R-3). The reaction represented by reaction formula (R-14) was carried out in the same manner as the reaction represented by reaction formula (R-3) in all aspects other than that the compound represented by formula (18) was used instead of the compound represented by formula (5). As a result, an intermediate represented by formula (19) shown below was yielded.

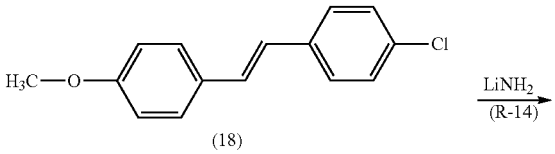

-continued

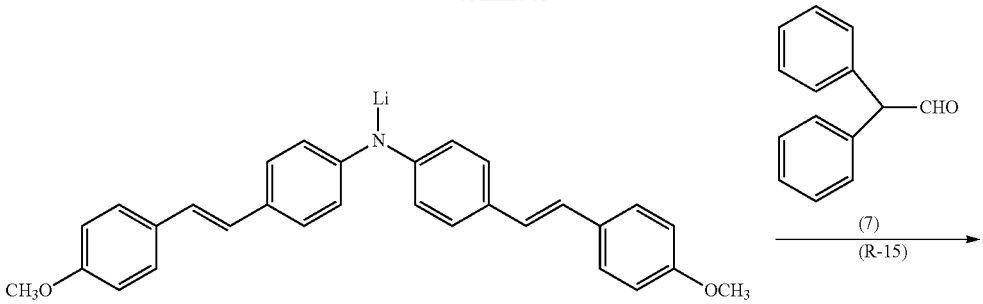

(19)

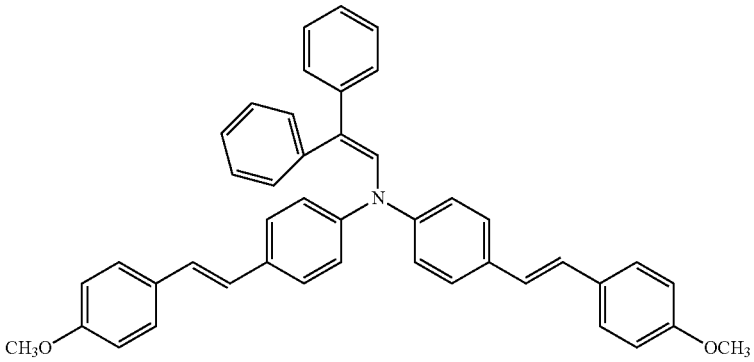

(HT-5)

Next, the intermediate represented by formula (19) was used instead of the intermediate represented by formula (6) in order to carry out a reaction represented by reaction formula (R-15) instead of the reaction represented by reaction formula (R-4). The reaction represented by reaction formula (R-15) was carried out in the same manner as the reaction represented by reaction formula (R-4) in all aspects other than that the intermediate represented by formula (19) was used instead of the intermediate represented by formula (6). As a result, the enamine derivative (HT-5) was yielded (percentage yield: 73 mol %).

Synthesis of Enamine Derivative (HT-6)

A reaction similar to that represented by reaction formula (R-1) was carried out to yield the compound represented by formula (3).

The compound represented by formula (13) was used instead of the compound represented by formula (4) in order to carry out a reaction represented by reaction formula (R-16) shown below instead of the reaction represented by reaction formula (R-2). The reaction represented by reaction formula (R-16) was carried out in the same manner as the reaction represented by reaction formula (R-2) in all aspects other than that the compound represented by formula (13) was used instead of the compound represented by formula (4). As a result, a compound represented by formula (20) shown below was yielded (percentage yield: 75 mol %).

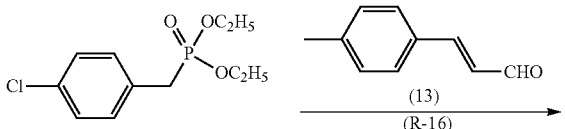

(3)

-continued

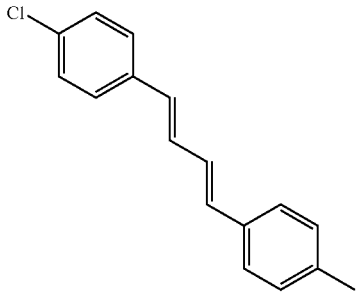

(20)

Next, the compound represented by formula (20) was used instead of the compound represented by formula (5) in order to carry out a reaction represented by reaction formula (R-17) shown below instead of the reaction represented by reaction formula (R-3). The reaction represented by reaction formula (R-17) was carried out in the same manner as the reaction represented by reaction formula (R-3) in all aspects other than that the compound represented by formula (20) was used instead of the compound represented by formula (5). As a result, an intermediate represented by formula (21) shown below was yielded.

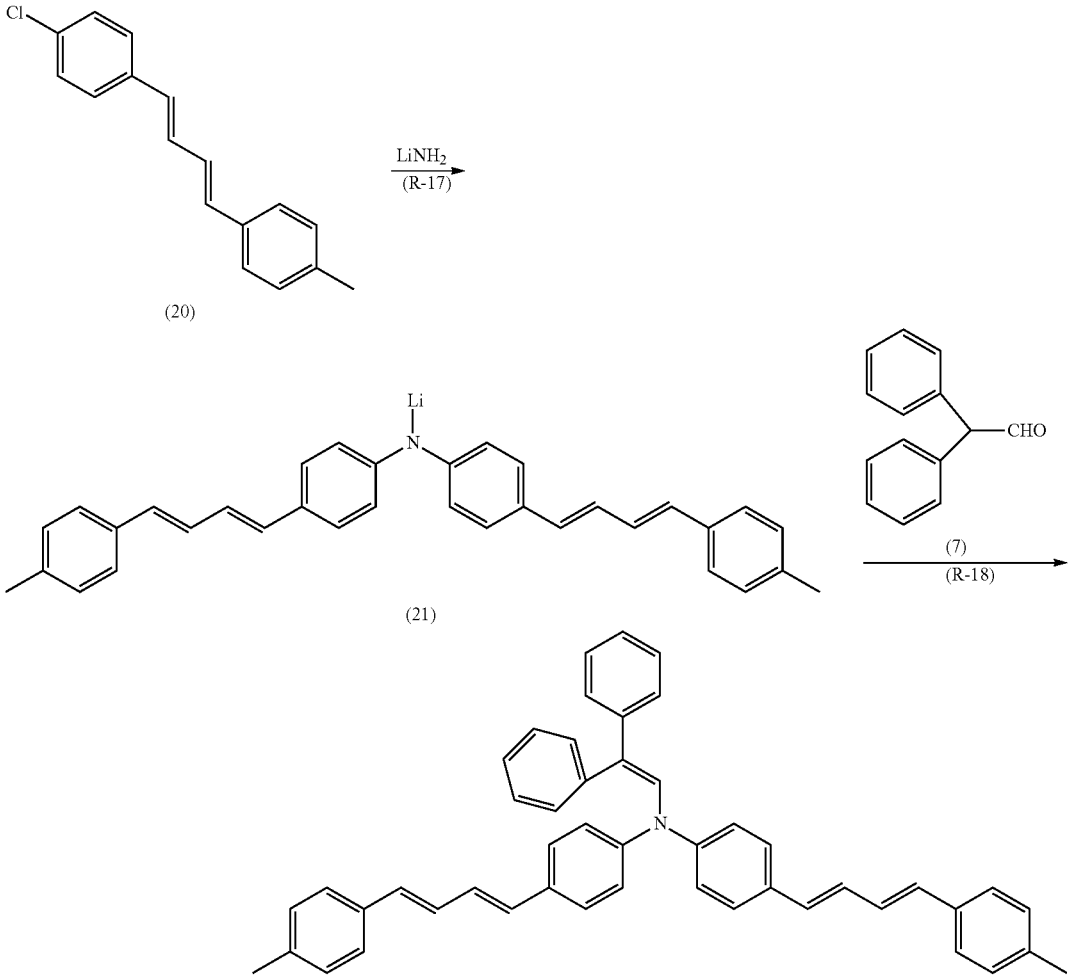

Next, the intermediate represented by formula (21) was used instead of the intermediate represented by formula (6) in order to carry out the reaction represented by reaction formula (R-18) instead of the reaction represented by reaction formula (R-4). The reaction represented by reaction formula (R-18) was carried out in the same manner as the reaction represented by reaction formula (R-4) in all aspects other than that the intermediate represented by formula (21) was used instead of the intermediate represented by formula (6). As a result, the enamine derivative (HT-6) was yielded (percentage yield: 70 mol %).

Single-Layer Photosensitive Member Production

[Production of Photosensitive Member A-1]

Into a container, 5 parts by mass of X-form metal-free phthalocyanine as a charge generating material, 80 parts by mass of the enamine derivative (HT-1) as a hole transport material, 50 parts by mass of an electron acceptor compound represented by formula (ET-1) shown below, 100 parts by mass of a polycarbonate resin (Z-form polycarbonate resin, Panlite (registered Japanese trademark) TS-2050 produced by Teijin Limited, viscosity average molecular weight 50,200) as a binder resin, and 800 parts by mass of tetrahydrofuran as a solvent were added. The container contents were mixed to obtain a mixture. Next, the mixture was dispersed for 50 hours using a ball mill, thereby obtaining an application liquid for single-layer type photosensitive layer formation (first application liquid).

(ET-1)

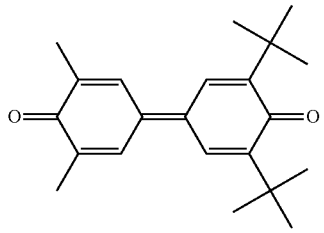

The resultant first application liquid was applied onto an aluminum drum (diameter 30 mm, length 238.5 mm). More specifically, the drum was dipped into the first application liquid at a rate of 5 mm/sec with one end of the drum pointed upward. Next, the applied application liquid was heated for 30 minutes at 100° C. to form a single-layer type photosensitive layer having a thickness of 25 μm. A photosensitive member A-1 being a single-layer photosensitive member was produced as a result of the above process.

[Production of Photosensitive Member A-2]

A photosensitive member A-2 was produced according to the same production method as the photosensitive member A-1 in all aspects other than that an electron acceptor compound represented by formula (ET-2) shown below was used instead of the electron acceptor compound represented by formula (ET-1).

(ET-2)

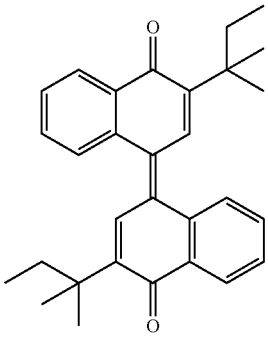

[Production of Photosensitive Member A-3]

A photosensitive member A-3 was produced according to the same production method as the photosensitive member A-2 in all aspects other than that Y-form titanyl phthalocyanine was used as a charge generating material instead of X-form metal-free phthalocyanine.

[Production of Photosensitive Member A-4]

A photosensitive member A-4 was produced according to the same production method as the photosensitive member A-1 in all aspects other than that the enamine derivative (HT-2) was used as a hole transport material instead of the enamine derivative (HT-1).

[Production of Photosensitive Member A-5]

A photosensitive member A-5 was produced according to the same production method as the photosensitive member A-4 in all aspects other than that the electron acceptor compound represented by formula (ET-2) was used instead of the electron acceptor compound represented by formula (ET-1).

[Production of Photosensitive Member A-6]

A photosensitive member A-6 was produced according to the same production method as the photosensitive member A-5 in all aspects other than that Y-form titanyl phthalocyanine was used as a charge generating material instead of X-form metal-free phthalocyanine.

[Production of Photosensitive Member A-7]

A photosensitive member A-7 was produced according to the same production method as the photosensitive member A-1 in all aspects other than that the enamine derivative (HT-3) was used as a hole transport material instead of the enamine derivative (HT-1).

[Production of Photosensitive Member A-8]

A photosensitive member A-8 was produced according to the same production method as the photosensitive member A-7 in all aspects other than that the electron acceptor compound represented by formula (ET-2) was used instead of the electron acceptor compound represented by formula (ET-1).

[Production of Photosensitive Member A-9]

A photosensitive member A-9 was produced according to the same production method as the photosensitive member A-8 in all aspects other than that Y-form titanyl phthalocyanine was used as a charge generating material instead of X-form metal-free phthalocyanine.

[Production of Photosensitive Member A-10]

A photosensitive member A-10 was produced according to the same production method as the photosensitive member A-1 in all aspects other than that the enamine derivative (HT-4) was used as a hole transport material instead of the enamine derivative (HT-1).

[Production of Photosensitive Member A-11]

A photosensitive member A-11 was produced according to the same production method as the photosensitive member A-10 in all aspects other than that the electron acceptor compound represented by Formula (ET-2) was used instead of the electron acceptor compound represented by Formula (ET-1).

[Production of Photosensitive Member A-12]

A photosensitive member A-12 was produced according to the same production method as the photosensitive member A-11 in all aspects other than that Y-form titanyl phthalocyanine was used as a charge generating material instead of X-form metal-free phthalocyanine.

[Production of Photosensitive Member A-13]

A photosensitive member A-13 was produced according to the same production method as the photosensitive member A-1 in all aspects other than that the enamine derivative (HT-5) was used as a hole transport material instead of the enamine derivative (HT-1).

[Production of Photosensitive Member A-14]

A photosensitive member A-14 was produced according to the same production method as the photosensitive member A-13 in all aspects other than that the electron acceptor compound represented by formula (ET-2) was used instead of the electron acceptor compound represented by formula (ET-1).

[Production of Photosensitive Member A-15]

A photosensitive member A-15 was produced according to the same production method as the photosensitive member A-14 in all aspects other than that Y-form titanyl phthalocyanine was used as a charge generating material instead of X-form metal-free phthalocyanine.

[Production of Photosensitive Member A-16]

A photosensitive member A-16 was produced according to the same production method as the photosensitive member A-1 in all aspects other than that the enamine derivative (HT-6) was used as a hole transport material instead of the enamine derivative (HT-1).

[Production of Photosensitive Member A-17]

A photosensitive member A-17 was produced according to the same production method as the photosensitive member A-16 in all aspects other than that the electron acceptor compound represented by formula (ET-2) was used instead of the electron acceptor compound represented by formula (ET-1).

[Production of Photosensitive Member A-18]

A photosensitive member A-18 was produced according to the same production method as the photosensitive member A-17 in all aspects other than that Y-form titanyl phthalocyanine was used as a charge generating material instead of X-form metal-free phthalocyanine.

[Production of Photosensitive Member B-1]

A photosensitive member B-1 was produced according to the same production method as the photosensitive member A-1 in all aspects other than that a triarylamine derivative represented by formula (HT-A) shown below was used as a hole transport material instead of the enamine derivative (HT-1).

(HT-A)

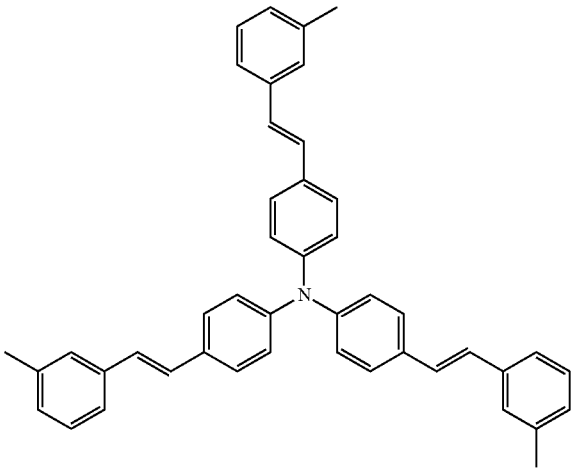

[Production of Photosensitive Member B-2]

A photosensitive member B-2 was produced according to the same production method as the photosensitive member B-1 in all aspects other than that the electron acceptor compound represented by formula (ET-2) was used instead of the electron acceptor compound represented by formula (ET-1) shown above.

[Production of Photosensitive Member B-3]

A photosensitive member B-3 was produced according to the same production method as the photosensitive member B-2 in all aspects other than that Y-form titanyl phthalocyanine was used as a charge generating material instead of X-form metal-free phthalocyanine.

[Production of Photosensitive Member B-4]

A photosensitive member B-4 was produced according to the same production method as the photosensitive member A-1 in all aspects other than that a triarylamine derivative represented by formula (HT-B) shown below was used as a hole transport material instead of the enamine derivative (HT-1).

(HT-B)

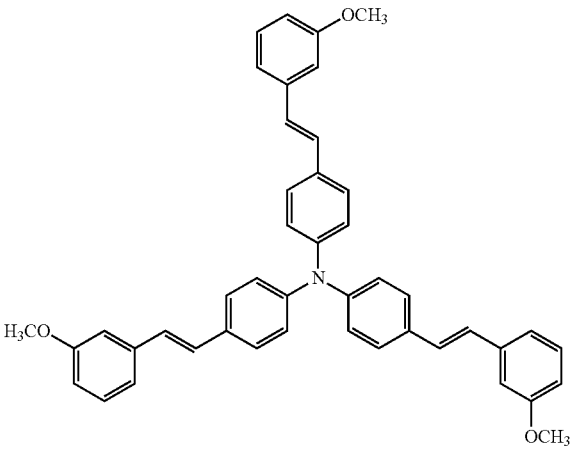

[Production of Photosensitive Member B-5]

A photosensitive member B-5 was produced according to the same production method as the photosensitive member B-4 in all aspects other than that the electron acceptor compound represented by formula (ET-2) was used instead of the electron acceptor compound represented by formula (ET-1) shown above.

[Production of Photosensitive Member B-6]

A photosensitive member B-6 was produced according to the same production method as the photosensitive member B-5 in all aspects other than that Y-form titanyl phthalocyanine was used as a charge generating material instead of X-form metal-free phthalocyanine.

(Evaluation of Electrical Characteristics)

With respect to each of the photosensitive members A-1 to A-18 and B-1 to B-6, the electrical characteristics were evaluated in the following manner. First, the surface of the photosensitive member was charged to a positive polarity using a drum sensitivity test device (product of Gen-Tech, Inc.). The surface potential of the photosensitive member in the charged state was measured and the measured surface potential was taken to be an initial surface potential ($V_0$, units: +V). Next, the monochromatic light (wavelength: 780 nm, half-width: 20 nm, and light intensity: 1.5 μJ/cm$^2$) was taken out from light emitted by a halogen lamp using a band pass filter. The monochromatic light was irradiated onto the surface of the photosensitive member (irradiation time: 1.5 seconds). The surface potential of the photosensitive member was measured once 0.5 seconds had elapsed after completion of the irradiation. The measured surface potential was taken to be a residual potential ($V_L$, units: +V). Measurement was performed under ambient conditions of 23° C. and 50% relative humidity.

(Evaluation of External Appearance of Photosensitive Members)

With respect to each of the photosensitive members A-1 to A-18 and B-1 to B-6, the entire surface region of photosensitive member was observed under an optical microscope at a magnification of ×50. Through the above observation, it was confirmed whether or not a crystallized portion was present at the surface of the photosensitive member. The external appearance of the photosensitive member was evaluated in accordance with the following standard.

Good: No crystallized portion observed

Poor: Crystallized portion observed

Table 1 shows the materials contained in each of the photosensitive members A-1 to A-18 and B-1 to B-6 and their evaluation results.

TABLE 1

| Photosensitive Member | Charge Generating Material | Hole Transport Material | Electron Acceptor Compound | Electrical Properties $V_0$ [+V] | Electrical Properties $V_L$ [+V] | External Appearance (Presence of Crystallization) |
|---|---|---|---|---|---|---|
| A-1 | X-form Metal-Free Phthalocyanine | HT-1 | ET-1 | 698 | 103 | Good |
| A-2 | X-form Metal-Free Phthalocyanine | HT-1 | ET-2 | 700 | 104 | Good |
| A-3 | Y-form Titanyl Phthalocyanine | HT-1 | ET-2 | 700 | 100 | Good |
| A-4 | X-form Metal-Free Phthalocyanine | HT-2 | ET-1 | 700 | 109 | Good |
| A-5 | X-form Metal-Free Phthalocyanine | HT-2 | ET-2 | 699 | 108 | Good |
| A-6 | Y-form Titanyl Phthalocyanine | HT-2 | ET-2 | 699 | 104 | Good |
| A-7 | X-form Metal-Free Phthalocyanine | HT-3 | ET-1 | 700 | 98 | Good |
| A-8 | X-form Metal-Free Phthalocyanine | HT-3 | ET-2 | 699 | 97 | Good |
| A-9 | Y-form Titanyl Phthalocyanine | HT-3 | ET-2 | 700 | 93 | Good |
| A-10 | X-form Metal-Free Phthalocyanine | HT-4 | ET-1 | 700 | 104 | Good |
| A-11 | X-form Metal-Free Phthalocyanine | HT-4 | ET-2 | 699 | 106 | Good |
| A-12 | Y-form Titanyl Phthalocyanine | HT-4 | ET-2 | 700 | 101 | Good |
| A-13 | X-form Metal-Free Phthalocyanine | HT-5 | ET-1 | 698 | 111 | Good |
| A-14 | X-form Metal-Free Phthalocyanine | HT-5 | ET-2 | 700 | 109 | Good |
| A-15 | Y-form Titanyl Phthalocyanine | HT-5 | ET-2 | 700 | 105 | Good |
| A-16 | X-form Metal-Free Phthalocyanine | HT-6 | ET-1 | 700 | 106 | Good |
| A-17 | X-form Metal-Free Phthalocyanine | HT-6 | ET-2 | 699 | 108 | Good |
| A-18 | Y-form Titanyl Phthalocyanine | HT-6 | ET-2 | 699 | 102 | Good |
| B-1 | X-form Metal-Free Phthalocyanine | HT-A | ET-1 | 699 | 125 | Good |
| B-2 | X-form Metal-Free Phthalocyanine | HT-A | ET-2 | 700 | 122 | Good |
| B-3 | Y-form Titanyl Phthalocyanine | HT-A | ET-2 | 701 | 119 | Good |
| B-4 | X-form Metal-Free Phthalocyanine | HT-B | ET-1 | 699 | 125 | Good |
| B-5 | X-form Metal-Free Phthalocyanine | HT-B | ET-2 | 700 | 122 | Good |
| B-6 | Y-form Titanyl Phthalocyanine | HT-B | ET-2 | 701 | 119 | Good |

As is understood from Table 1, with respect to the photosensitive members according to the present disclosure each containing the enamine derivative (1), no crystallized portion was observed on the surface of the photosensitive member and the residual potential ($V_L$) was low. The evaluation results show that the photosensitive members according to the present embodiment each exhibit excellent electrical characteristics while inhibiting crystallization in the photosensitive layer.

What is claimed is:

1. An electrophotographic photosensitive member comprising:

a conductive substrate; and a single-layer type photosensitive layer located on the conductive substrate and containing a charge generating material, a charge transport material, an electron acceptor compound, and a binder resin, wherein the charge transport material is an enamine derivative represented by either one of formulae (HT-2) and (HT-3)

(HT-2)

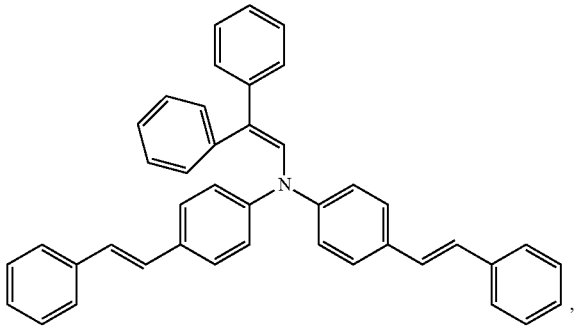

,

-continued (HT-3)

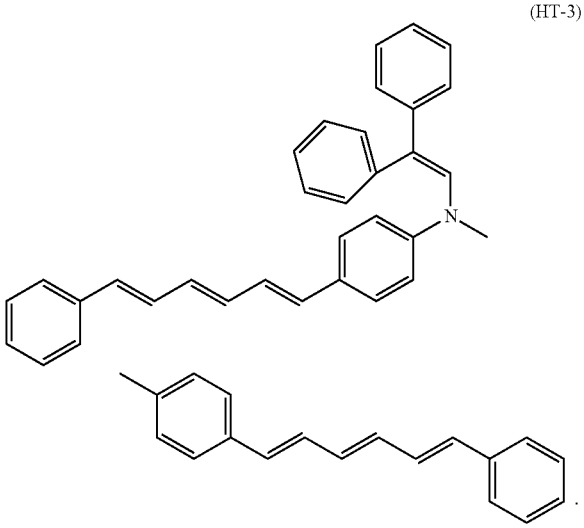

2. The electrophotographic photosensitive member according to claim 1, wherein the charge generating material is a titanyl phthalocyanine having a Y-form crystal structure.

3. The electrophotographic photosensitive member according to claim 1, wherein the enamine derivative is represented by formula (HT-3).

4. The electrophotographic photosensitive member according to claim 1, wherein the electron acceptor compound is represented by either one of formulae (ET-1) and (ET-2)

(ET-1)

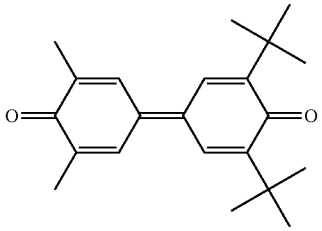

(ET-2)

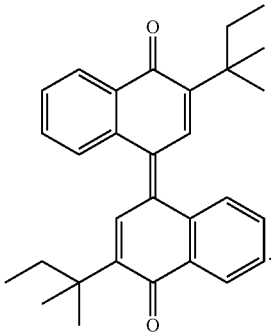

* * * * *